US005193861A

United States Patent [19]

Juga et al.

[11] Patent Number: 5,193,861

[45] Date of Patent: Mar. 16, 1993

[54] LATCH

[75] Inventors: Douglas Juga; Gilbert Krahn, both of Kenosha, Wis.

[73] Assignee: A. L. Hansen Mfg. Co., Waukegan, Ill.

[21] Appl. No.: 920,621

[22] Filed: Jul. 24, 1992

[51] Int. Cl.[5] ..... E05C 3/10

[52] U.S. Cl. ..... 292/49; 292/207

[58] Field of Search ..... 292/24, 25, 27, 30, 292/49, 124, 207, 191, 192; 70/121, 122, 123

[56] References Cited

U.S. PATENT DOCUMENTS

| | | | |
|---|---|---|---|
| D. 231,723 | 6/1974 | Pastva, Jr. et al. | D8/7 |
| 2,720,774 | 10/1955 | Gehrie | 292/27 X |
| 3,397,002 | 8/1968 | Russell et al. | 292/192 |
| 3,857,594 | 12/1974 | Pastva, Jr. | 292/27 |

FOREIGN PATENT DOCUMENTS

| | | | |
|---|---|---|---|
| 878619 | 10/1942 | France | 292/27 |

*Primary Examiner*—Richard E. Moore

*Attorney, Agent, or Firm*—Willian Brinks Olds Hofer Gilson & Lione

[57] ABSTRACT

A latch includes a housing and first and second latch arms. Each latch arm defines a latching end, and the arms are pivotable between a latching position and a release position. A rotatable cam longitudinally shifts a latch arm follower, and the latch arms define bearing surfaces which engage the latch arm follower. The latch arms are configured such that movement of the latch arm follower toward the latching ends moves the bearing surfaces in a direction tending to move the latch arms to the release position.

19 Claims, 2 Drawing Sheets

LATCH

BACKGROUND OF THE INVENTION

This invention relates to an improved, simplified design for a latch of the type having a housing and first and second latch arms, wherein the latch arms each define a latching end and are pivotable in the housing between a latching position, in which the latching ends are positioned closer to one another to engage a striker, and a release position, in which the latching ends are positioned farther from one another to release the striker.

A latch of the general type described above is shown in U.S. Pat. No. 3,857,594. The latch disclosed in this patent uses a manually rotatable cam to shift a plate that engages outboard edges of the latch arms such that when the plate is moved away from the latching arms, the latch arms are pulled from the latching to the release position. The latch arms are biased to the latching position by coil springs that surround pins secured to move axially as the latch arms pivot. A locking mechanism works by limiting travel of these pins, and thus the pins, the latch arms and the plate are interposed between the locking mechanism and the manually operated cam.

The linkage disclosed in the above identified patent is relatively complex, and it is made of a relatively large number of intricately formed parts. It is a primary object of this invention to provide an improved linkage for a latch of the type described initially above, which has a smaller number of parts, which can be manufactured more inexpensively, and which can be assembled more easily.

SUMMARY OF THE INVENTION

According to a first aspect of this invention, a latch of the type initially described above is provided with a manually rotatable cam and a latch arm follower guided for movement in the housing and movable by the cam. Each latch arm defines a respective bearing surface, and the bearing surfaces are positioned to engage the latch arm follower and are configured such that movement of the latch arm follower toward the latching ends moves the bearing surfaces in a direction tending to move the latch arms to the release position.

According to a second aspect of this invention, a latch of the type described initially above is provided with a cam and latch arm as described above. The bearing surface defined by each latch arm contacts the latch arm follower on the same side of the latch arm pivot axis as a central axis of the latch extending from the cam rotation axis to a point midway between the latching ends.

As pointed out below, the present invention can be implemented in a relatively simple, easy to manufacture latch which is reliable in operation.

DETAILED DESCRIPTION OF THE PRESENTLY PREFERRED EMBODIMENTS

Figure 1:
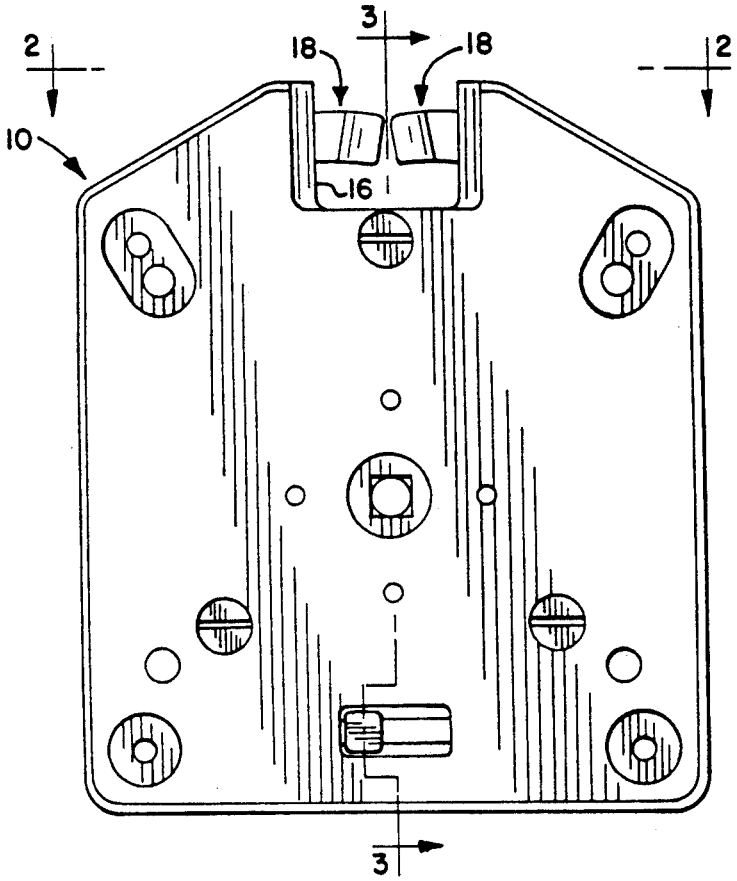
FIG. 1 is a front view of a latch which incorporates a presently preferred embodiment of this invention.
Figure 3:
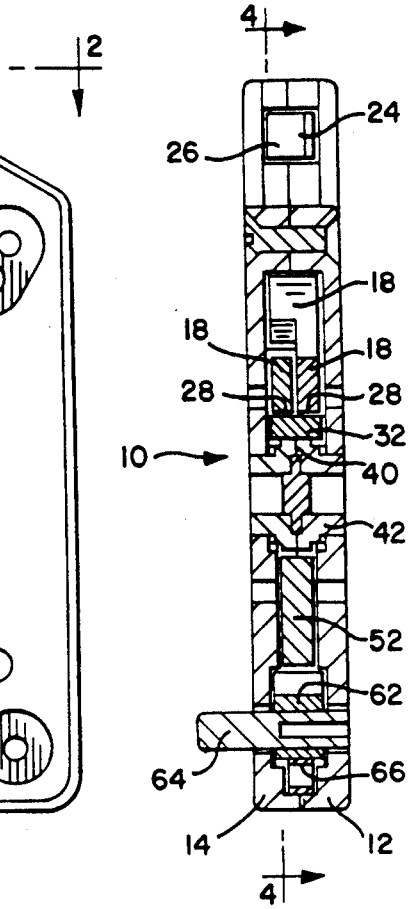
FIG. 3 is a sectional view taken along line 3—3 of FIG. 1.
Figure 2:
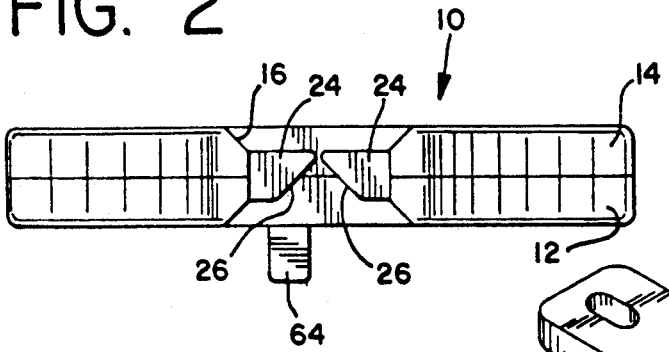
FIG. 2 is an end view taken along line 2—2 of FIG. 1.
Figure 6:
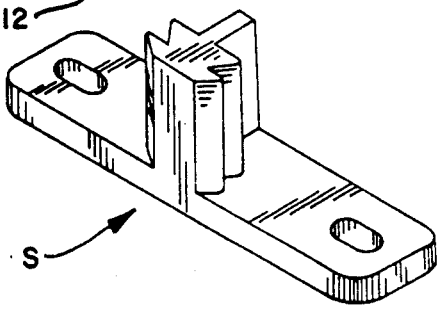
FIG. 6 is a perspective view of a striker suitable for use with the latch of FIGS. 1–5.

Turning now to the drawings, FIGS. 1–5 show various views of a latch 10 that incorporates a presently preferred embodiment of this invention. As best shown in FIGS. 2 and 3, the latch 10 includes a housing comprising housing parts 12 and 14. The housing 12, 14 defines a centrally located notch 16 which is generally rectangular in shape and is disposed at a front portion of the latch 10. The notch 16 is shaped to receive a striker S as shown in FIG. 6.

Figure 4:
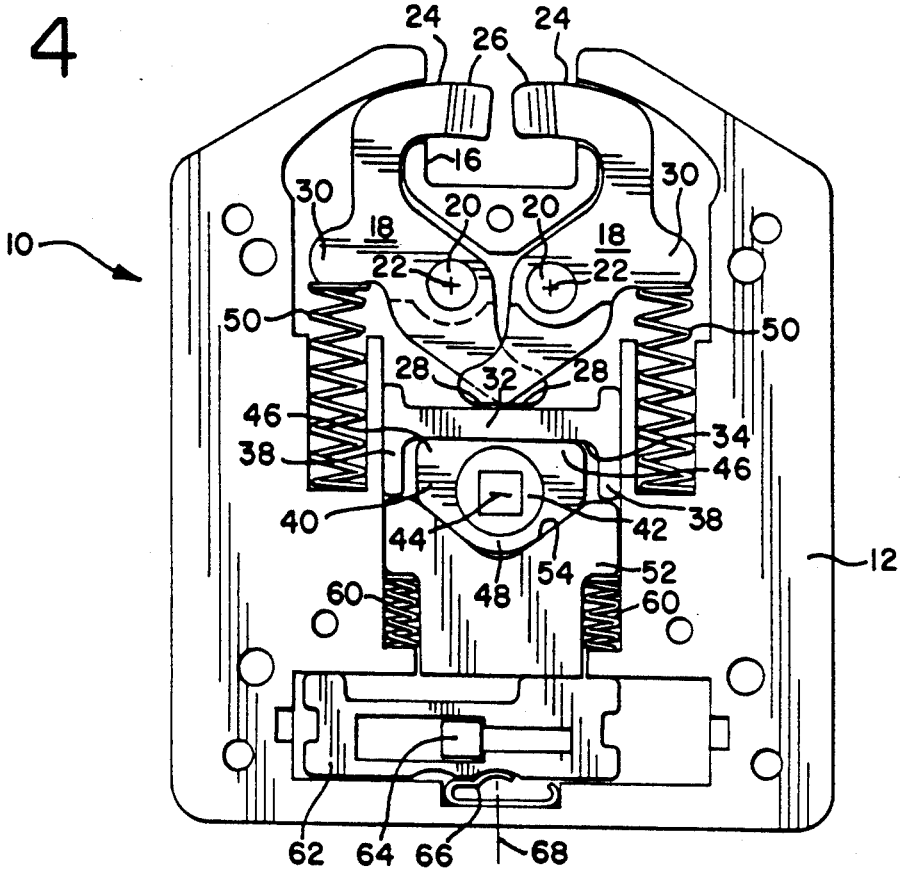
FIG. 4 is a sectional view taken along line 4—4 of FIG. 3 showing the latch in the locked and latched position.

As best shown in FIG. 4, the latch 10 includes two opposed latch arms 18. Each of the latch arms 18 defines a pair of bosses 20 which are rotatably mounted in complementary recesses in the housing 12, 14. The bosses 20 define respective pivot axes 22, and the latch arms 18 are free to rotate about the pivot axes 22 in the housing 12, 14. Each of the latch arms 18 defines a latching end 24 which in turn defines a beveled face 26. In addition, each of the latch arms 18 defines a bearing surface 28 and a protrusion 30.

As best shown in FIG. 4, the latch 10 includes a follower 32 which is mounted in a guide way defined by the housing 12, 14 for sliding, rectilinear movement. The follower 32 defines opposed first and second surfaces 34, 36 which are generally parallel and opposed flanges 38 which are positioned to engage the sides of the guide way defined by the housing 12, 14 to guide the follower 32 in sliding movement.

As best shown in FIG. 4, a manually rotatable cam 40 is mounted in the housing 12, 14. The cam 40 includes a central sleeve 42 which is journaled for rotation about a rotational axis defined by recesses in the housing 12, 14. The cam rotation axis is identified in FIG. 4 by the reference symbol 44. The cam 40 defines two lobes 46 positioned in contact with the surface 34 of the follower 32. In addition, the cam 40 defines a V shape lobe 48 which extends away from the latch arms 18.

As shown in FIG. 4, a pair of latch arm springs 50 are mounted in recesses defined by the housing 12, 14 to bear directly on the protrusions 30 of the latch arms 18. The latch arm springs 50 in this embodiment are coil compression springs which bias the latch arms 18 to the latched position shown in FIG. 4.

An additional follower 52 is also mounted in the housing 12, 14 to slide along the same guide way as that which receives the follower 32. The additional follower 52 defines a V shaped recess 54 which is shaped to receive the V shaped lobe 48. A pair of springs 60 are interposed between the housing 12, 14 and the additional follower 52 to bias the additional follower 52 toward the cam 40.

Figure 5:
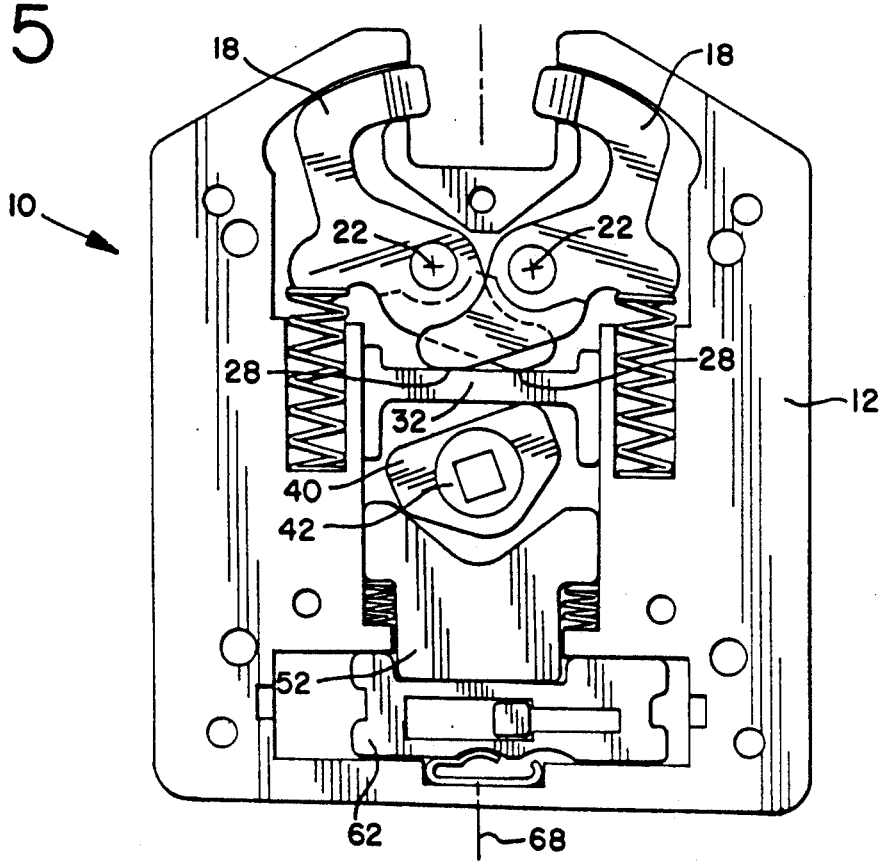
FIG. 5 is a view corresponding to FIG. 4 showing the latch the unlocked and released position.

As shown in FIG. 4, a locking element 62 is mounted between the housing parts 12, 14 for sliding movement transversely to the path of the additional follower 52. The locking element 62 comprises a button 64 that protrudes out of an opening in the housing part 12. This button 64 can be used to shift the locking element 62 between a locked position (FIG. 4) and an unlocked position (FIG. 5). A spring 66 engages recesses in one edge of the locking element 62 to hold the locking element 62 in either of the positions shown in FIGS. 4 and 5.

The latch 10 defines a central axis identified by the reference symbol 68 in FIG. 4. This central axis 68 extends between the rotational axis 44 of the cam 40 and a point midway between the latching ends 24 of the latch arms 18.

OPERATION

FIG. 4 shows the latch 10 in the rest, locked position. The springs 50 bias the latch arms 18 to the latching position, and the springs 60 bias the additional follower 52 to the position shown in FIG. 4, thereby automatically centering the cam 40. When the locking element 62 is in the position shown in FIG. 4, the locking element 62 blocks the path of the additional follower 52, and prevents the additional follower 52 from moving away from the rotational axis 44. In this way, the locking element 62 prevents rotation of the cam 40, and thereby prevents a user from rotating the cam 40 to open the latch arms 18. Nevertheless, the latch arms 18 are free to move from the latching to the release positions without causing the cam 40 to rotate, as for example when the latch 10 is slammed closed over a striker, such as the striker S shown in FIG. 6.

In order to use the cam 40 to release the latch 10, the locking element 62 must first be moved to the unlocked position shown in FIG. 5, in which the locking element 62 is positioned out of the path of the additional follower 52. Then the cam 40 is manually rotated, as for example with a handle (not shown) fitted into the rectangular opening in the sleeve 42. When the cam 40 is rotated to the position shown in FIG. 5 the follower 32 is moved toward the latch arms 18. The motion of the follower 32 is transferred to latch arms 18 by the bearing surfaces 28, which rotate the latch arms 18 around the pivot axes 22 to the release position shown in FIG. 5. The springs 50 and 60 are compressed as the cam 40 is rotated from the latched position of FIG. 4 to the release position of FIG. 5.

From this explanation it should be clear that the follower 32 and the additional follower 52 are guided in rectilinear sliding movement parallel to the central axis 68. For each of the latch arms 18, the respective pivot axis 22 and latching end 24 are on the same side of the central axis 68. The respective latching end 24 and bearing surface 28 are on opposite sides of the central axis 68. The bearing surfaces 28 are symmetrically positioned on opposite sides of the central axis 68, and for each of the latch arms 18 the respective bearing surface 28 is positioned on the same side of the respective pivot axis 22 as is the central axis 68.

The arrangement described above is simple, direct, inexpensive to manufacture and straightforward to assemble.

Of course, it should be understood that a wide range of changes and modifications can be made to the preferred embodiment described above. It is therefore intended that the foregoing detailed description be regarded as illustrative rather than limiting, and that it be understood that it is the following claims, including all equivalents, which are intended to define the scope of this invention.

We claim:

1. In a latch of the type comprising a housing; first and second latch arms, each mounted to pivot with respect to the housing; said latch arms each defining a latching end and pivotable between a latching position, in which the latching ends are positioned closer to one another to engage a striker, and a release position, in which the latching ends are positioned farther from one another to release the striker; the improvement comprising:

a manually rotatable cam;

a latch arm follower guided for movement in the housing and movable by the cam;

a pair of bearing surfaces, each defined by a respective one of the latch arms, said bearing surfaces positioned to engage the latch arm follower and configured such that movement of the latch arm follower toward the latching ends moves the bearing surfaces in a direction tending to move the latch arms to the release position.

2. In a latch of the type comprising a housing; first and second latch arms, each mounted to pivot with respect to the housing; said latch arms each defining a latching end and pivotable between a latching position, in which the latching ends are positioned closer to one another to engage a striker, and a release position, in which the latching ends are positioned farther from one another to release the striker; the improvement comprising:

a manually rotatable cam;

a latch arm follower guided for movement in the housing and movable by the cam;

a pair of bearing surfaces, each defined by a respective one of the latch arms, said bearing surfaces positioned to engage the latch arm follower;

said latch defining a central axis extending from a cam rotation axis defined by the rotatable cam to a point midway between the latching ends;

each of said latch arms pivoting about a respective pivot axis;

each of said bearing surfaces contacting the latch arm follower (1) on the same side of the respective pivot axis as the central axis and (2) on the same side of a line extending between the pivot axes as the cam.

3. The invention of claim 1 or 2 further comprising:

an additional follower guided for movement along a path in the housing and movable by the cam; and a locking element guided for movement in the housing between a locked position, in which the locking element extends into the path to obstruct movement of the additional follower and thereby of the cam, and an unlocked position, in which the locking element is positioned out of the path to allow movement of the additional follower and thereby of the cam.

4. The invention of claim 3 wherein the additional follower and the cam define complementary V shaped surfaces, and wherein at least one spring biases the additional follower toward the cam to bias the cam toward a centered position.

5. The invention of claim 1 or 2 further comprising:

a pair of springs, each mounted to bear against the housing and a respective one of the latch arms to bias the latch arms to the latching position, said latch arm follower and said bearing surfaces disposed between the springs.

6. The invention of claim 1 or 2 wherein the latch arm follower is guided for sliding movement substantially without rotation in the housing, wherein the latch arm follower defines a first surface oriented to contact the cam and a second surface oriented to contact the bearing surfaces, and wherein the first and second surfaces are substantially parallel.

7. The invention of claim 6 wherein the cam defines first and second lobes oriented to contact the first surface, said lobes positioned such that rotation of the cam from a rest position in either direction moves the latch arm follower toward the latch arms.

8. The invention of claim 1 wherein said latch defines a central axis extending from a cam rotation axis defined by the rotatable cam to a point midway between the latching ends, and wherein each of the latch arms pivots about a respective pivot axis.

9. The invention of claim 8 or 2 wherein, for each of the latch arms, the respective bearing surface and the respective latching end are disposed on opposite sides of the central axis.

10. The invention of claim 9 wherein, for each of the latch arms, the respective pivot axis and the respective latching end are disposed on the same side of the central axis.

11. The invention of claim 10 wherein the bearing surfaces are symmetrically positioned with respect to one another on opposite sides of the central axis.

12. In a latch of the type comprising a housing; first and second latch arms, each mounted to pivot with respect to the housing; said latch arms each defining a latching end and pivotable between a latching position, in which the latching ends are positioned closer to one another to engage a striker, and a release position, in which the latching ends are positioned farther from one another to release the striker; the improvement comprising:

a manually rotatable cam;

a latch arm follower guided for movement in the housing and movable by the cam;

a pair of bearing surfaces, each defined by a respective one of the latch arms, said bearing surfaces positioned to engage the latch arm follower;

said latch defining a central axis extending from a cam rotation axis defined by the rotatable cam to a point midway between the latching ends;

each of said latch arms pivoting about a respective pivot axis;

each of said bearing surfaces containing the latch arm follower on the same side of the respective pivot axis as the central axis;

an additional follower guided for movement along a path in the housing and movable by the cam; and a locking element guided for movement in the housing between a locked position, in which the locking element extends into the path to obstruct movement of the additional follower and thereby of the cam, and an unlocked position, in which the locking element is positioned out of the path to allow movement of the additional follower and thereby of the cam.

13. The invention of claim 12 wherein the additional follower and the cam define complementary V shaped surfaces, and wherein at least one spring biases the additional follower toward the cam to bias the cam toward a centered position.

14. In a latch of the type comprising a housing; first and second latch arms, each mounted to pivot with respect to the housing; said latch arms each defining a latching end and pivotable between a latching positions, in which the latching ends are positioned closer to one another to engage a striker, and a release position, in which the latching ends are positioned farther from one another to release the striker; the improvement comprising:

a manually rotatable cam;

a latch arm follower guided for movement in the housing and movable by the cam;

a pair of bearing surfaces, each defined by a respective one of the latch arms, said bearing surfaces positioned to engage the latch arm follower;

said latch defining a central axis extending from a cam rotation axis defined by the rotatable cam to a point midway between the latching ends;

each of said latch arms pivoting about a respective pivot axis;

each of said bearing surfaces contacting the latch arm follower on the same side of the respective pivot axis as the central axis; and a pair of springs, each mounted to bear against the housing and a respective one of the latch arms to bias the latch arms to the latching position, said latch arm follower and said bearing surfaces disposed between the springs.

15. In a latch of the type comprising a housing; first and second latch arms, each mounted to pivot with respect to the housing; said latch arms each defining a latching end and pivotable between a latching position, in which the latching ends are positioned closer to one another to engage a striker, and a release position, in which the latching ends are positioned farther from one another to release the striker; the improvement comprising:

a manually rotatable cam;

a latch arm follower guided for movement in the housing and movable by the cam;

a pair of bearing surfaces, each defined by a respective one of the latch arms, said bearing surfaces positioned to engage the latch arm follower;

said latch defining a central axis extending from a cam rotation axis defined by the rotatable cam to a point midway between the latching ends;

each of said latch arms pivoting about a respective pivot axis;

each of said bearing surfaces contacting the latch arm follower on the same side of the respective pivot axis as the central axis;

wherein the latch arm follower is guided for sliding movement substantially without rotation in the housing, wherein the latch arm follower defines a first surface oriented to contact the cam and a second surface oriented to contact the bearing surfaces, and wherein the first and second surfaces are substantially parallel.

16. The invention of claim 15 wherein the cam defines first and second lobes oriented to contact the first surface, said lobes positioned such that rotation of the cam from a rest position in either direction moves the latch arm follower toward the latch arms.

17. In a latch of the type comprising a housing; first and second latch arms, each mounted to pivot with respect to the housing; said latch arms each defining a latching end and pivotable between a latching position, in which the latching ends are positioned closer to one another to engage a striker, and a release position, in which the latching ends are positioned farther from one another to release the striker; the improvement comprising:

a manually rotatable cam;

a latch arm follower guided for movement in the housing and movable by the cam;

a pair of bearing surfaces, each defined by a respective one of the latch arms, said bearing surfaces positioned to engage the latch arm follower;

said latch defining a central axis extending from a cam rotation axis defined by the rotatable cam to a point midway between the latching ends;

each of said latch arms pivoting about a respective pivot axis;

each of said bearing surfaces contacting the latch arm follower on the same side of the respective pivot axis as the central axis;

wherein, for each of the latch arms, the respective bearing surface and the respective latching and are disposed on opposite sides of the central axis.

18. The invention of claim 17 wherein, for each of the latch arms, the respective pivot axis and the respective latching end are disposed on the same side of the central axis.

19. The invention of claim 18 wherein the bearing surfaces are symmetrically positioned with respect to one another on opposite sides of the central axis.

* * * * *

UNITED STATES PATENT AND TRADEMARK OFFICE

CERTIFICATE OF CORRECTION

PATENT NO. : 5,193,861
DATED : March 16, 1993
INVENTOR(S) : Douglas Juga et al.

It is certified that error appears in the above-indentified patent and that said Letters Patent is hereby corrected as shown below:

Column 5:

In claim 12, line 42, delete "containing" and substitute therefor --contacting--.

Signed and Sealed this

Twenty-sixth Day of April, 1994

Bruce Lehman

*Attest:*

BRUCE LEHMAN

*Attesting Officer*

*Commissioner of Patents and Trademarks*